US005320366A

United States Patent [19]

Shing

[11] Patent Number: 5,320,366

[45] Date of Patent: Jun. 14, 1994

[54] ASSEMBLY FOR CONVERTING INLINE ROLLER SKATE TO ICE SKATE

[76] Inventor: Lawrence Shing, 1 Forest Glen, Mountain View, Calif. 94043

[21] Appl. No.: 26,982

[22] Filed: Mar. 5, 1993

[51] Int. Cl.[5] ..... A63C 17/18

[52] U.S. Cl. ..... 280/7.14; 280/11.18

[58] Field of Search ..... 280/7.13, 7.14, 11.12, 280/11.18, 11.22, 11.23

[56] References Cited

U.S. PATENT DOCUMENTS

| | | | |
|---|---|---|---|
| 480,610 | 8/1892 | Nielson | 280/11.22 |
| 1,530,211 | 3/1925 | Siemnash | 280/7.13 |
| 1,900,040 | 9/1931 | Brien . | |
| 2,209,116 | 7/1940 | Friedmann | 280/11.10 |
| 2,424,819 | 7/1947 | Guttridge | 280/7.13 |
| 3,292,940 | 12/1966 | Weitzner | 280/7.13 |
| 3,367,669 | 2/1968 | Collins | 280/11.3 |
| 4,932,675 | 6/1990 | Olson et al. | 280/7.13 |
| 5,092,614 | 3/1992 | Malewicz | 280/11.22 |
| 5,129,663 | 7/1992 | Soo et al. | 280/7.14 |
| 5,137,290 | 8/1992 | Patterson et al. | 280/11.12 |

FOREIGN PATENT DOCUMENTS

| | | | |
|---|---|---|---|
| 0809397 | 7/1951 | Fed. Rep. of Germany | 280/7.13 |
| 0841871 | 6/1952 | Fed. Rep. of Germany | 280/7.13 |
| 0206209 | 11/1939 | Switzerland | 280/7.13 |
| 339850 | 7/1959 | Switzerland . | |

*Primary Examiner*—Margaret A. Focarino
*Assistant Examiner*—Peter English
*Attorney, Agent, or Firm*—Flehr, Hohbach, Test, Albritton & Herbert

[57] ABSTRACT

A conversion assembly for converting an in-line roller skate to an ice skate for use on ice. The roller skate is of a type having a boot with a sole and a frame structure mounted thereto. The frame structure includes two longitudinally extending, spaced apart parallel support members provided with at least three sets of transversely aligned bores longitudinally spaced apart thereon. At least three wheels are disposed longitudinally between the support members and rotatably mounted thereto by fasteners which include a fastening element for extending through each wheel and related set of aligned bores in the support members. The conversion assembly comprises a thin longitudinally extending skating blade having a sharp bottom edge adapted to engage the ice and at least three upstanding tab portions longitudinally spaced apart along the top thereof. At least three sets of first and second clamping elements are adapted to be disposed between the support members in place of the wheels and have opposed clamping surfaces for frictionally engaging the tab portions. The clamping elements are provided with aligned holes therein through which the fastening elements extend to securely clamp the skating blade to the frame structure. The tab portions of the skating blade and the clamping elements are cooperatively configured to resist movement of the skating blade relative to the frame structure.

13 Claims, 5 Drawing Sheets

ASSEMBLY FOR CONVERTING INLINE ROLLER SKATE TO ICE SKATE

This invention pertains generally to skating, and more particularly to assemblies for converting roller skates to ice skates.

Numerous skates have been provided which can be converted from a roller skate to an ice skate or even a walking shoe. See, for example, U.S. Pat. No. 3,292,940 issued to Weitzner, U.S. Pat. No. 1,900,040 issued to Brien and Swiss Patent No. 339,850 issued to Gattinger. Bases assemblies which attach to skate boots and permit conversion from an ice skate to a roller skate and vice versa have also been devised. See U.S. Pat. No. 5,129,663 issued to Soo. However, the conversion assemblies of these skates and bases are boot specific and are limited in use to the specific skate or assembly for which it has been designed; these conversion assemblies are not interchangeable with each other or existing ice skates or roller skates.

In recent years, in-line roller skating has become increasingly popular due in part to the introduction of several lines of in-line boots. In general, as illustrated in FIG. 1, a currently available in-line roller skate 15, such as that manufactured by Canstar Sports Group Inc. of Mississauga, Ontario, Canada, also known as Bauer Power Corps, or Rollerblade, Inc. of Minnetonka, Minn., includes a boot 16 having a heel 17 and toe 18 and a shell 22 made from a relatively stiff material such as high strength injection molded plastic. Shell 22 has a liner 23 therein and is formed with a sole 26. A rigid frame structure 27 made from a suitable stiff material such as high strength injection molded plastic is attached to sole 26. Frame structure 27 includes depending first and second spaced apart parallel support members 28 and 31 which extend longitudinally from heel 17 to toe 18 and are braced by a plurality of cross members 32 which are formed integral therewith and extend therebetween. Four wheels 33 are disposed longitudinally between support members 28 and 31 and cross members 32 and rotate in a common plane generally parallel with the planes generally formed by the support members.

Support members 28 and 31 are provided with a set of first and second transversely aligned slots 36 and 37, one for each wheel 33, longitudinally spaced apart thereon. Slots 36 and 37 are each configured to receive an insert 38 which snaps therein, with each longitudinally extended insert 38 being provided with a bore 41 at one end thereof. Fastening means in the form of a fastening element or bolt 42 having a first end with an Allen socket 43 formed in the head thereon and an opposite second threaded end and a fastener or nut 44 are provided for rotatably mounting wheels 33 to frame structure 27. Each bolt 42 extends through a transversely aligned set of bores 41 and the center of a wheel 33 and is secured in place by a nut 44.

Slots 36 and 37 at the front and rear of support members 28 and 31 extend longitudinally in directions generally parallel with support members 28 and 31, while the two sets of slots 36 and 37 in the center of support members 28 and 31 extend generally vertically in directions generally perpendicular to front and rear slots 36 and 37. The centers of wheels 33, bolts 42 and insert bores 41 are at all times aligned along an arc 45. As can be appreciated by those skilled in the art, the side profile configuration of arcuately aligned wheels 33 can be adjusted so that the radius of the arc 45 can be increased or decreased. Slots 36 and 37 and inserts 38 do not permit the centers of wheels 33, bolts 42 and insert bores 41 to be linearly aligned.

Other in-line roller skates, such as roller skate 51 illustrated in part in FIG. 6, can linearly align the axes of rotation of the four wheels 33 thereof (not shown in the drawings) along a longitudinally extending line 53. Roller skate 51 is substantially similar to skate 15 and has a boot 54 with a frame structure 56 mounted thereto. Frame structure 56 includes first and second support members 57 braced by cross members 58. Each support member 57 is provided with four sets of first and second transversely aligned holes or bores 61 longitudinally spaced apart thereon along line 53 to permit mounting of wheels 33 between the support members and cross members 58 therebetween. Holes 61 can be similar to slots 36 and 37 to permit use of adjustment inserts similar to inserts 38 for changing the longitudinal wheel alignment of roller skate 51, but roller skates similar to roller skate 51 often do not permit longitudinal alignment of the wheel rotation axes along a line.

Still other roller skates, not shown in the drawings, are designed for small children or other people and have only three in-line wheels or are designed for speed skating and have five or more wheels.

It is in general an object of the invention to provide a new and improved assembly for converting an in-line roller skate to an ice skate.

Another object of the invention is to provide a conversion assembly of the above character which is adaptable to roller skates having wheels aligned in an arcuate side profile configuration and to roller skates having wheels aligned in a linear side profile configuration.

Another object of the invention is to provide a conversion assembly of the above character which includes a minimum number of components and is relatively easy to use.

Another object to the invention is to provide a conversion assembly of the above character which provides a relatively rigid and sturdy attachment of the ice blade to the roller skate boot.

These and other objects are achieved in accordance with the invention by providing a conversion assembly for converting an in-line roller skate to an ice skate for use on ice. The in-line roller skate is of a type having a boot with a sole and a frame structure mounted thereto. The frame structure has depending first and second longitudinally extending, spaced apart parallel support members. At least three sets of first and second transversely aligned bores are longitudinally spaced apart on the support members. At least three wheels rotatable in a common plane are disposed longitudinally between the first and second support members. Fastening means is provided for rotatably mounting the wheels to the support members and includes at least three sets of fastening elements which extend through the wheels and the first and second aligned bores in the support members.

The conversion assembly comprises a thin longitudinally extending skating blade having a sharp bottom edge adapted to engage the ice and at least three upstanding tab portions longitudinally spaced apart along the top of the skating blade. At least three sets of first and second clamping elements are adapted to be disposed between the first and second support members in place of the wheels and have opposed first and second clamping surfaces for frictionally engaging the tab portions of the skating blade. The clamping elements are provided with aligned holes therein through which the fastening elements extend to securely clamp the skating blade to the frame structure. The tab portions of the skating blade and the clamping elements have cooperative mating means to resist movement of the skating blade relative to the frame structure.

In one embodiment of the invention, the cooperative mating means includes a longitudinally extending slot in at least one of the tab portions. The slot is formed from an inner surface having a top and bottom. A boss extends from the first clamping surface along a central axis of at least one of the first clamping elements for snug disposition between the top and bottom of the inner slot forming surface of the tab portion. The hole in the first clamping element extends through the boss thereof off center the central axis so that the hole in the first clamping element may be aligned with the respective first and second transversely aligned bores in the support members by rotation of the first clamping element in the hole in the skating blade.

In another embodiment, the cooperative mating means includes a hole in at least one of the tab portions. Aligned bosses extend from the first and second clamping surfaces of at least one set of the first and second clamping elements for disposition within the tab portion hole. The holes in the clamping elements extend through the aligned bosses. A flexible strip interconnects the first and second clamping elements and retains the bosses in alignment. The skating blade is mounted to the boot by selecting clamping elements having holes therethrough which align, when the clamping elements are mounted to the skating blade, with the first and second transversely aligned bores in the support members.

Figure 1:
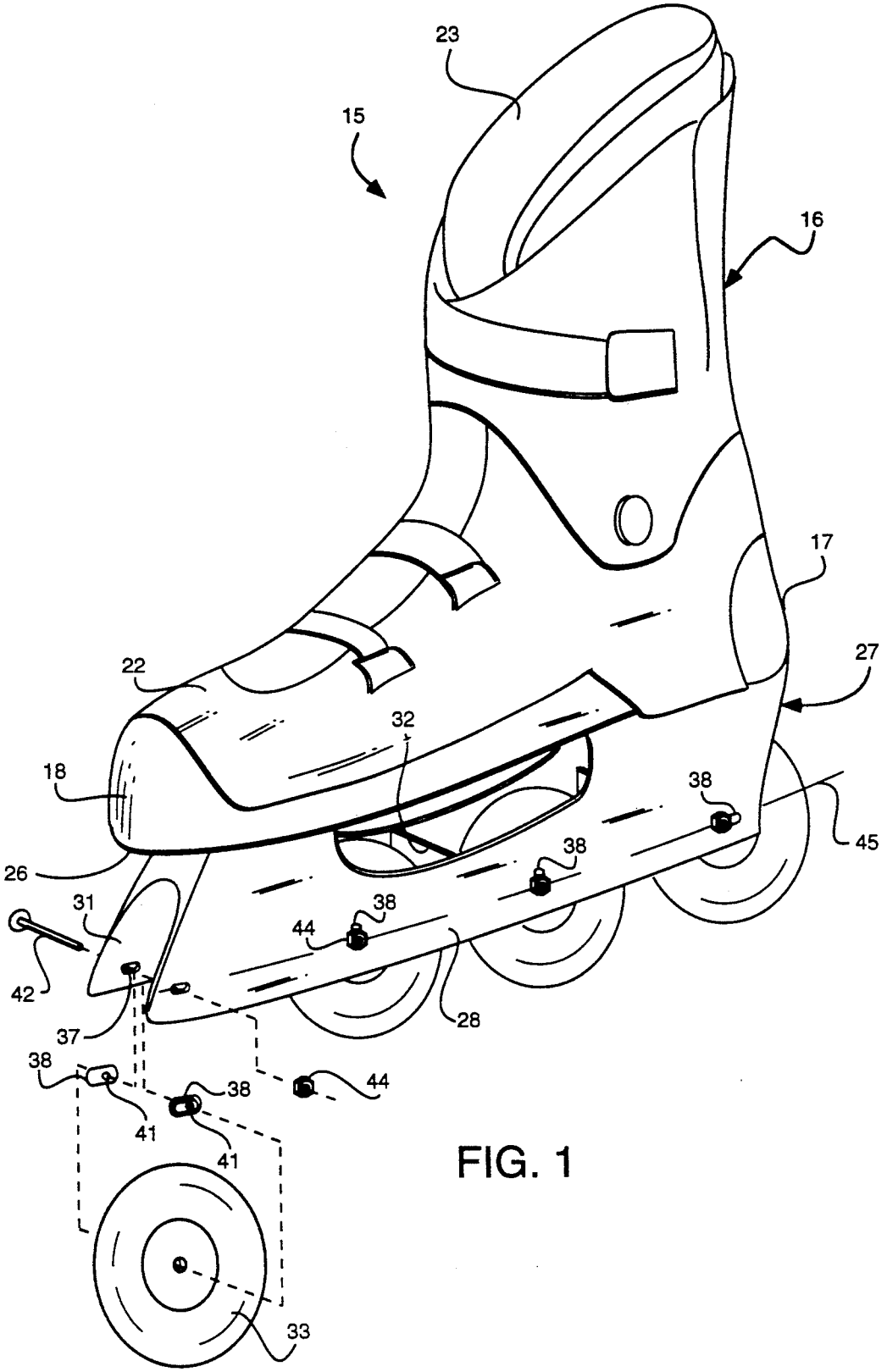
FIG. 1 is a perspective view of a conventional in-line roller skate boot with one wheel exploded.
Figure 2:
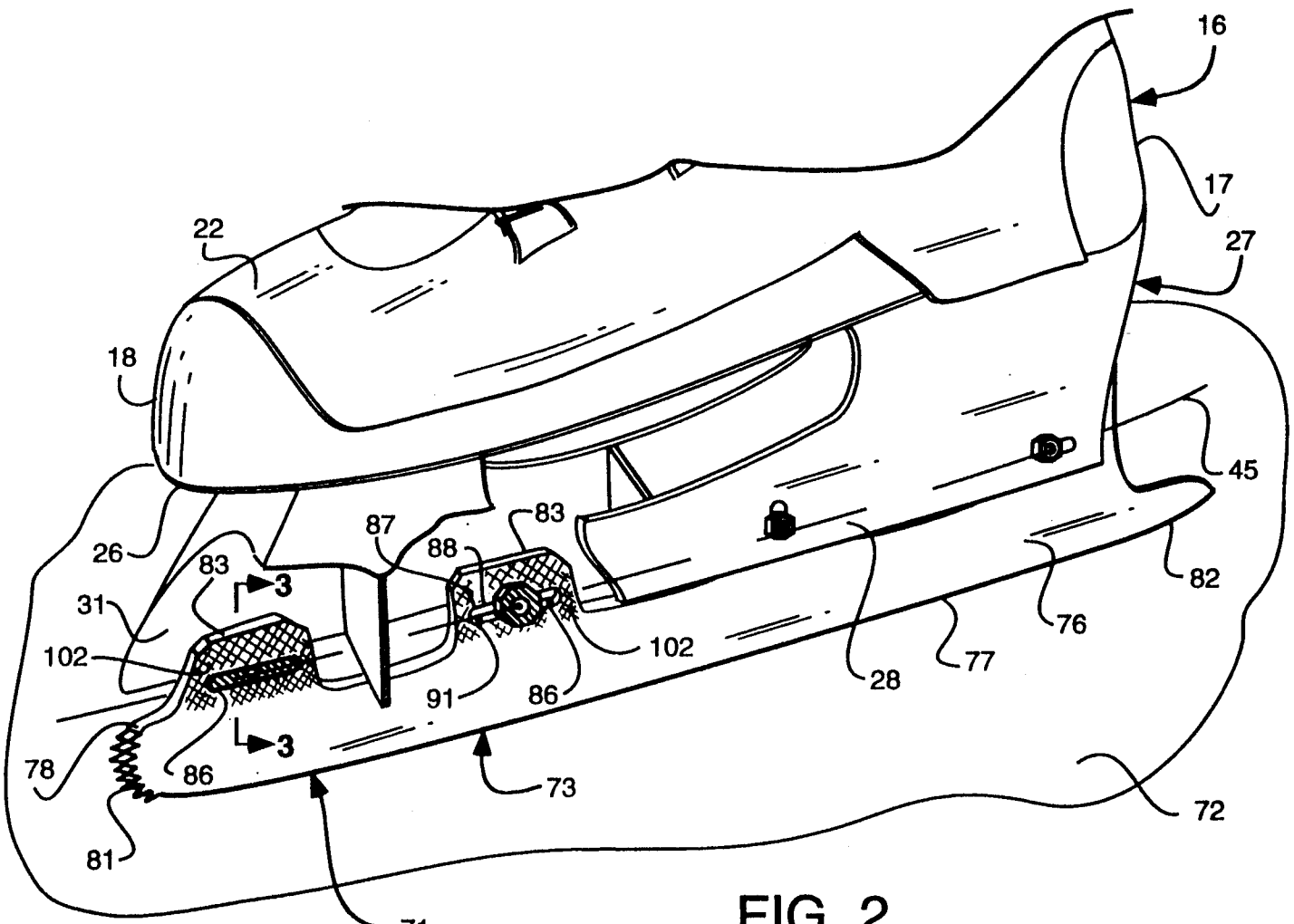
FIG. 2 is a perspective view, partially cut away, of a portion of the conventional in-line roller skate boot shown in FIG. 1 incorporating the conversion assembly of the present invention.

Conversion assembly 71 of the present invention is for converting an in-line roller skate, such as roller skate 15 or 51 described above, to an ice skate for use on ice 72. Assembly 71 includes a thin longitudinally extending figure skating blade 73 made of any suitable material such as hardened steel and having opposite and generally parallel and planar side surfaces 76 separated at the bottom by a sharp edge 77 adapted to engage ice 72 (See FIG. 2). Skating blade 73 is formed with four upstanding tab portions or tabs 83 which are each generally rectangular when viewed in elevational plan. Tabs 83 are longitudinally spaced-apart across the top of skating blade 73 and are sized and configured so as to permit disposition between first and second support members 28 and 31 and cross members 32 interconnecting support members 28 and 31. Each tab 83 is formed with a longitudinally extending hole or slot 86 extending between side surfaces 76 and formed from an inner surface 87 which includes a top surface 88 and a bottom surface 91. Slots 86 are generally vertically aligned on skating blade 73, and respective top and bottom surfaces 88 and 91 of each slot 86 are generally equidistant from each other.

Figure 3:
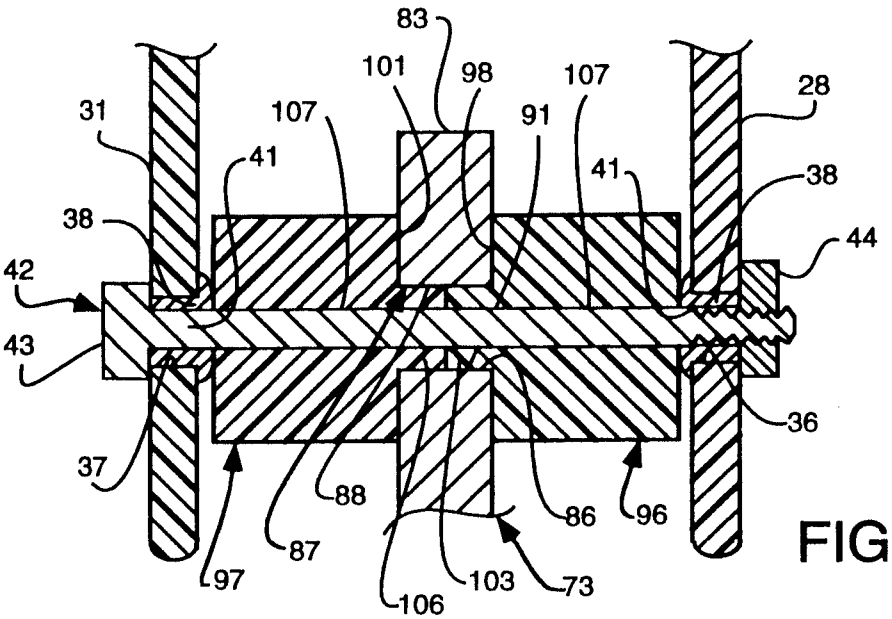
FIG. 3 is a cross-sectional view taken along the line 3—3 of FIG. 2.

Conversion assembly 71 further includes a plurality of first and second clamping elements adapted to be disposed between first and second support members 28 and 31 in place of wheels 33. First and second blocks 96 and 97 serve as the forwardmost set of first and second clamping elements and are made of any suitable material such as hardened plastic. Blocks 96 and 97 have opposed first and second clamping surfaces 98 and 101 for frictionally engaging the forwardmost tab 83 of skating blade 73 (see FIGS. 2 and 3). Side surfaces 76 of the forwardmost tab 83 are formed with friction means in the form of knurls 102 thereon for enhancing the frictional engagement between the tab and first and second clamping surfaces 98 and 101 and reducing any slippage therebetween. Each of clamping surfaces 98 and 101 have respective bosses 103 and 106 extending therefrom which extend approximately half of the way through forwardmost slot 86 and generally abut at the center thereof. Bosses 103 and 106 each have a cross-sectional configuration sized and dimensioned to conform with the cross-sectional configuration of forwardmost slot 86 and, as a result, the bosses are snugly disposed within and generally abut inner surface 87 thereof. Aligned bores 107 extend through each of first block and boss 96 and 103 and second block and boss 97 and 106 and are aligned with the transversely aligned bores 41 of forwardmost inserts 38 to permit a bolt 42 to extend therethrough and be secured therein by a nut 44.

First and second blocks 111 and 112 serve as the first and second clamping elements which engage the two middle tabs 83 and the rearwardmost tab 83 of skating blade 73 and are made of any suitable material such as hardened plastic. Blocks 111 and 112 have respective first and second clamping surfaces 113 and 116 for frictionally engaging the respective tabs 83 (See FIGS. 4 and 5). Side surfaces 76 of these tabs 83 are also formed with knurls 102 thereon for enhancing this frictional engagement. First block 111 is generally centered on a longitudinal axis 117 which extends perpendicularly through first clamping surface 113. First block 111 has a body portion with a cross section in the shape of a equilateral octagon and an outer surface formed from eight planar rectangular surfaces 118 generally aligned about axis 117. A boss portion or boss 121 extends from first clamping surface 113 and is generally centered on longitudinal axis 117. Boss 121 has a cross section generally in the shape of an equilateral octagon, an outer surface generally formed from eight rectangular planar surfaces 122 aligned about axis 117, and a planar end surface 123 which is approximately parallel with first clamping surface 113. The distance between respective opposite and parallel boss surfaces 122 is approximately equal to the distance between top and bottom surfaces 88 and 91 of slots 86. A hole or bore 126 extends longitudinally through first block 111, including boss 121 thereof, off center longitudinal axis 117.

Second block 112 has a central longitudinal axis 131 which extends perpendicularly through second clamping surface 101 and a cross section in the shape of an equilateral octagon, the outer surface thereof being formed from eight rectangular planar side surfaces 132 aligned about axis 131. A recess or cavity 133 is provided in second clamping surface 116 and is dimensioned and configured to cooperatively receive the end portion of first block boss 121. In this regard, recess 133 is generally formed from eight planar side surfaces 136 aligned about axis 131, having a cross-sectional configuration generally in the shape of an equilateral octagon, and an end surface 137 which perpendicularly adjoins side surfaces 136. A bore 138 extends longitudinally through first block 111 and opens into recess 133. Bore 138 is off center longitudinal axis 131 the same distance that bore 126 of first block 111 is off center longitudinal axis 117 thereof.

Figure 5:
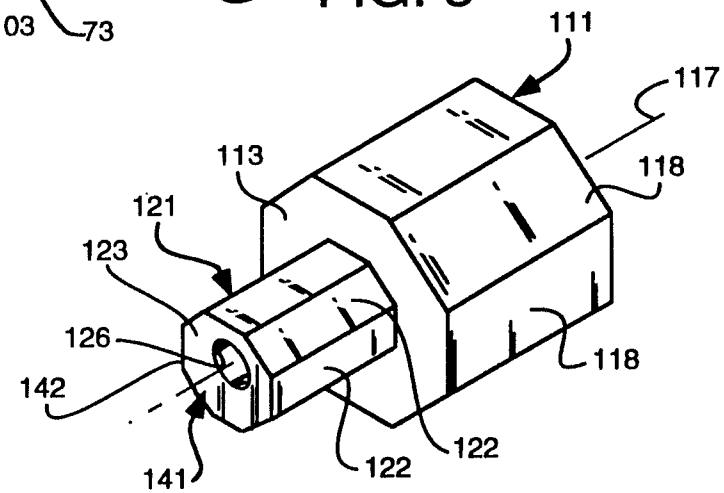
FIG. 5 is a perspective view of a clamping element relating to the clamping element shown in FIG. 4.
Figure 4:
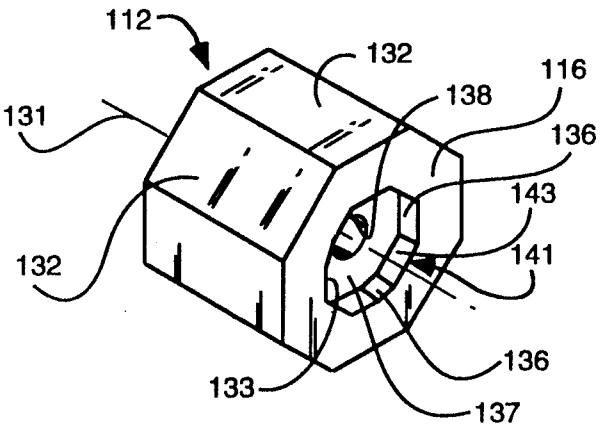
FIG. 4 is a perspective view of one of the clamping elements of the conversion assembly shown in FIG. 2.

First and second blocks 111 and 112 include a key way system 141 which serves as key way means for angularly aligning the end portion of first block boss 121 within second block recess 133 so that respective bores 126 and 138 thereof are in alignment. As illustrated in FIGS. 4 and 5, key way system 141 is in the form of a ninth planar surface or flat 142 interconnecting two surfaces 122 of boss 121 and an equally wide and aligned flat 143 interconnecting two side surfaces 136 within recess 133.

Inner surfaces 87 of slots 86, first and second bosses of first and second blocks 96 and 97 and boss 121 of first block 111 are included in the cooperative mating means of conversion assembly 71 to resist movement of skating blade 73 relative to frame structure 56. In addition, slots 86, top and bottom surfaces 88 and 91 thereof and first block bosses 121 with off-center bores 126 therein are included in the hole position adjustment means which permit alignment of bores 126 with bores 41 of inserts 38 carried by first and second support members 28 and 31.

The method of converting roller skate 15 to an ice skate with the use of conversion assembly 71 will now be briefly described. Four wheels 33 are removed from frame structure 27 by loosening each of bolts 42 and respective nuts 44 relative to each other and removing bolts 42 from bores 41 of inserts 38. First and second blocks 96 and 97 are positioned on the forwardmost tab 83 of skating blade 73 by disposing respective first and second bosses 103 and 106 within slot 86 of the tab. A set of first and second blocks 111 and 112 are positioned on each of the middle two tabs 83 and the rearwardmost tab 83 of skating blade 73. Boss 121 of each first block 111 extends through the respective slot 86, with the end thereof disposed within recess 133 of second block 112.

Boss 121 of each first block 111 is angularly aligned within respective slot 86 so that bore 126 therein is elevationally aligned with bores 41 of the respective inserts 38 in first and second support members 28 and 31 when skating blade 73 is mounted to frame structure 27. As can be appreciated by those skilled in the art, rotation of first block 111 and boss 121 causes the elevational height of bore 126 therein to increase or decrease with respect to the bottom of the block and boss. Since each set of opposite surfaces 122 of each boss 121 are generally parallel and equidistant from each other, the opposite surfaces 122 serving as the boss top and bottom surfaces snugly abut slot top and bottom surfaces 88 and 91 at each angular position of boss 121 within slot 86.

Once blocks 96 and 97 and the three sets of blocks 111 and 112 have been so positioned on skating blade 73 and conversion assembly 71 disposed between first and second support members 28 and 31, a bolt 42 is extended through transversely aligned bores 41 and respective aligned bores 107 of first and second blocks 96 and 97 and transversely aligned bores 41 and respective bores 126 and 138 of first and second blocks 111 and 112. Each bolt 42 is secured in place by the tightening of respective nut 44. Skating blade 73 is retained in its desired horizontal position with respect to boot 16 by the snug engagement of first and second bosses 103 and 106 of blocks 96 and 97 with inner surface 87 of the forwardmost slot 86. The snug engagement of bosses 121 with respective top and bottom surfaces 88 and 91 of the remaining slots 86 assist first and second blocks 96 and 97 in retaining skating blade 73 in its desired elevational position with respect to boot 16. Opposite boss side surfaces 122 engaging slot top and bottom surfaces 88 and 91 contribute to the relatively large aggregate surface area for distributing loads and forces transferred between conversion assembly 71 and frame structure 56. Knurls 102 enhance the frictional engagement of first and second clamping surfaces 98 and 101 and first and second clamping surfaces 113 and 116 with side surfaces 76 of respective tabs 83.

Conversion assembly 71 can be used for converting in-line roller skates having a variety of wheel alignments to ice skates. First and second blocks 111 and 112 permit attachment of conversion assembly 71 to roller skates having wheels aligned in various arcuate configurations and to roller skates having wheels in linear alignment. Tabs 83 are longitudinally spaced and slots 86 are longitudinally sized to accommodate a variety of roller skates.

It should be appreciated that a conversion assembly similar to conversion assembly 71 can be utilized for converting roller skates with boots smaller than boot 16 and having only three in-line wheels thereon or roller skates with boots larger than boot 16 and having five or more in-line wheels thereon and be within the scope of the present invention. Furthermore, with respect to certain roller skate boots, first and second blocks 96 and 97 may be utilized for frictionally engaging both the forwardmost and rearwardmost tabs 83, thereby requiring utilization of first and second blocks 111 and 112 or other blocks having hole position adjustment means only for the middle one or two tabs 83 of skating blade 73. As a result, the conversion of a roller skate to an ice skate with the conversion assembly of the present invention requires at least three sets of first and second clamping elements and at least one clamping element be similar to first block 111 to permit alignment of bore 126 thereof with respective transversely aligned bores 41 in frame structure 27.

Figure 6:
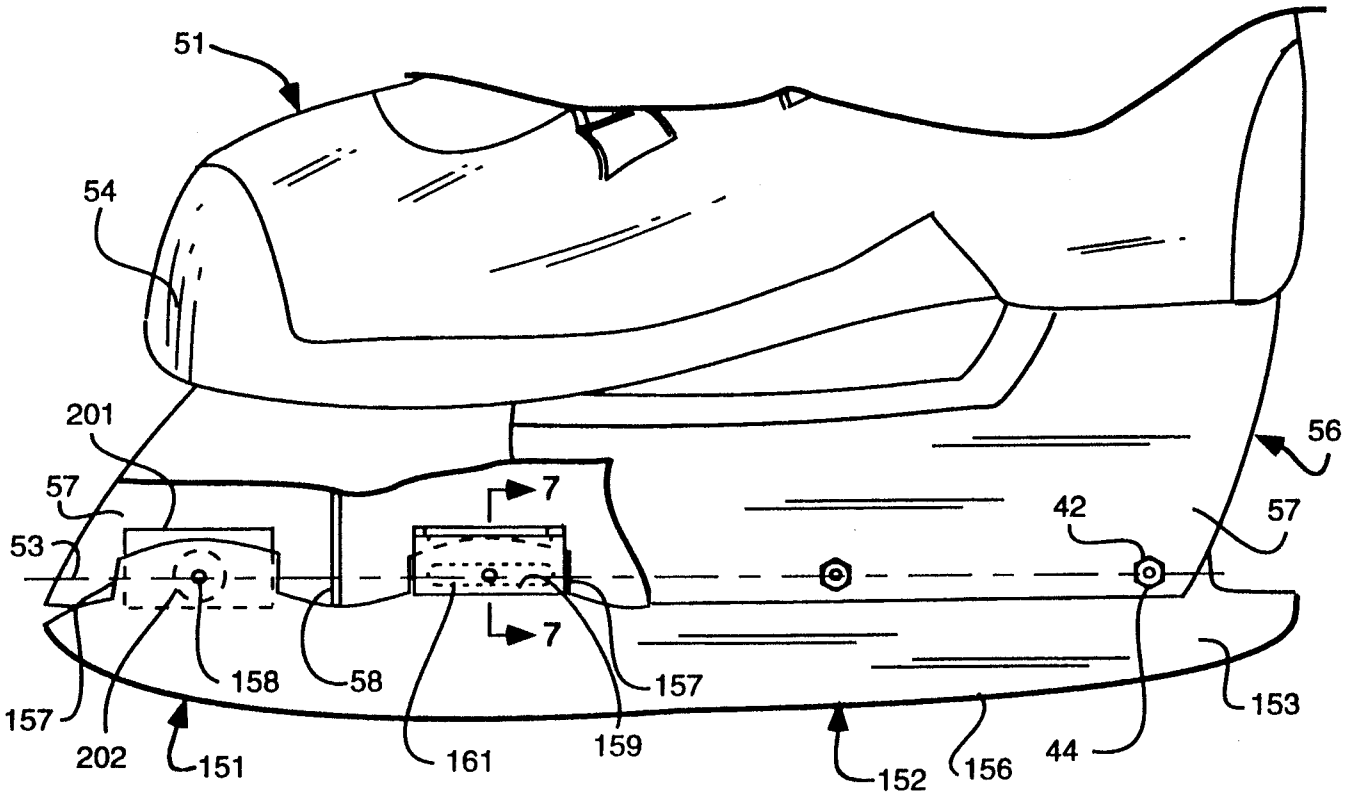
FIG. 6 is a side elevational view of a portion of another in-line roller skate boot incorporating the conversion assembly of the present invention.

The assembly for converting in-line roller skates to ice skates can have other embodiments and be within the scope of the present invention. For example, conversion assembly 151 illustrated in FIGS. 6 through 8 with respect to roller skate 51 includes a thin longitudinally extending hockey skating blade 152 made of any suitable material such as hardened steel and having opposite and generally parallel and planar side surfaces 153 separated at the bottom by a sharpened edge 156. Four upstanding tab portions or tabs 157 are formed longitudinally along the top of skating blade 152, each being generally rectangular in cross-sectional configuration. The forwardmost tab 157 is provided with a hole or bore 158 extending between side surfaces 153 thereof and the remaining three tabs 157 are each provided with a hole in the form of a longitudinally extending slot 159 which is substantially similar to slot 86.

Figure 7:
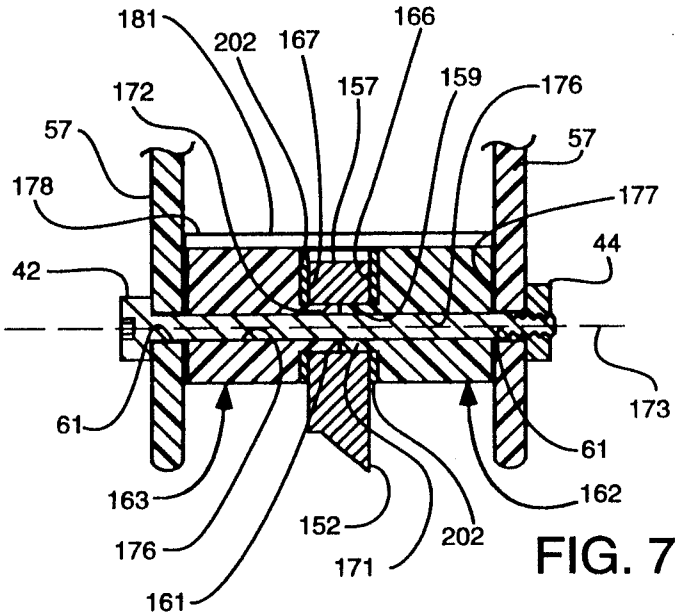
FIG. 7 is a cross-sectional view taken along the line 7—7 of FIG. 6.

Conversion assembly 151 further includes first and second clamping elements in the form of first and second clamping blocks 162 and 163 made of any suitable material such as hardened plastic (see FIG. 7). Blocks 162 and 163 are substantially similar to first and second blocks 96 and 97. Blocks 162 and 163 have respective first and second clamping surfaces 166 and 167 with respective bosses 171 and 172 extending therefrom along a longitudinal axis 173. Bosses 171 and 172 have a cross-sectional configuration sized and dimensioned to be cooperatively received by slots 159 and snugly abut inner surface 161 thereof. A hole or bore 176, elevationally centered with respect to axis 173, extends through blocks 162 and 163 and is configured and dimensioned to snugly receive a fastening element such as bolt 42. Blocks 162 and 163 have respective planar top surfaces 177 and 178 and are interconnected by a flexible strip 181 made of any suitable material such as plastic which is mounted at each end to top surfaces 177 and 178 by any suitable bonding means known by those skilled in the art. Strip 181 serves to retain bosses 171 and 172 in alignment with the ends thereof generally abutting each other.

Figure 8:
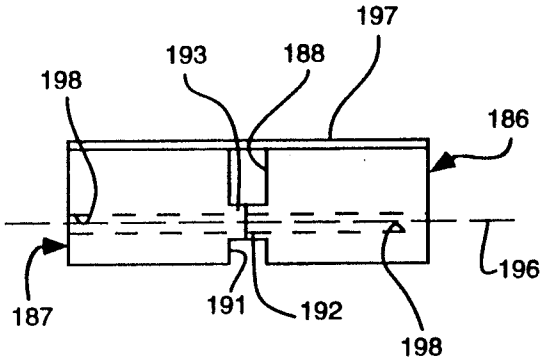
FIG. 8 is a side elevational view of a set of clamping elements, similar to the set of clamping elements shown in FIG. 7, relating to the conversion assembly shown in FIG. 6.

The first and second clamping elements of conversion assembly 151 can also be in the form of first and second blocks 186 and 187 having respective first and second clamping surfaces 188 and 191 with first and second bosses 192 and 193 extending therefrom along a central longitudinal axis 196 (See FIG. 8). A flexible strip 197 interconnects blocks 186 and 187, which are substantially identical to blocks 162 and 163 except that bore 19 extending therethrough is off center longitudinal axis 196.

Conversion assembly 151 further includes additional clamping elements in the form of first and second spacer blocks 201 which serve to clamp the forwardmost tab 157 between support members 57 of frame structure 56 and are adapted to be disposed between support members 57. Blocks 201 have aligned bores therethrough which are configured and sized to receive a fastening element such as bolt 42.

Friction means in the form of thin annular gaskets 202 are provided in conversion assembly 151. Gaskets 202 are made of any suitable material such as rubber and have central bores therethrough. Sets of gaskets 202 are disposed between the clamping elements of conversion assembly 151 and side surfaces 153 of tabs 157 for enhancing the frictional engagement and reducing any slippage therebetween. Gaskets 202 can be mounted to the clamping surfaces of the clamping elements and be within the scope of the present invention.

In operation and use of conversion assembly 151 on roller skate 51, skating blade 152 is initially secured to frame structure 56 by mounting forwardmost tab 157 thereof between the forwardmost set of transversely aligned bores 61 of support members 57. In this regard, sets of gaskets 202 and spacer blocks 201 are disposed on either side of forwardmost tab 157 with each gasket 202 sandwiched between respective spacer block 201 and tab side surface 153. The bores in spacer blocks 201 and gaskets 202 are aligned with tab bore 158 and support member bores 61 so as to permit insertion of a bolt 42 therethrough.

Appropriate sets of clamping elements, substantially similar to first and second blocks 162 and 163, are then selected for mounting to the two inner or middle tabs 157 and the rearwardmost tab 157 of skating blade 152. Blocks 162 and 163 are separated by bending flexible strip 181 and then snapped about tabs 157. Gaskets 202 are disposed between respective blocks 162 and 163 and tab side surface 153. Bores 176 in all three sets of blocks 162 and 163 are elevationally equidistant from respective top surfaces 177 and 178 thereof and, when blocks 162 and 163 are so mounted to tabs 157, in elevational alignment with the linearly aligned bores 61 spaced along each of support members 57. The horizontal alignment of bores 176 in blocks 162 and 163 and respective bosses 171 and 172 permits horizontal or longitudinal alignment with respective transversely aligned bores 61. This horizontal alignment of bores 176 may vary for each set of blocks 162 and 163 depending upon, among other things, the size of boot 54. A bolt 42 is inserted through each set of transversely aligned bores 61 and 176 and secured therein by a nut 44.

By selecting blocks 162 and 163 having bores 176 therein which longitudinally align with the respective transversely aligned bores 61 in support members 57 when the blocks are mounted to respective tabs 157, conversion assembly 151 can be mounted to a variety of boots 54 having frame structures 56 with linearly aligned bores 61 on each support member 57 thereof despite bores 61 having a different longitudinal spacing on each frame structure 56. Tabs 157 are longitudinally spaced and slots 159 are longitudinally sized to accommodate a variety of roller skates.

Conversion assembly 151 can be adapted for use with roller skate boots, such as boot 16, having in-line wheels which are arcuately aligned. In this regard, first and second clamping elements similar to first and second blocks 186 and 187 and having bores 198 therethrough which are elevationally off center can be utilized for properly aligning skating blade 152 with frame structure 56.

It should be appreciated that certain conversion assemblies incorporating the present invention may be able to have bores similar to bore 158 in the forwardmost and rearwardmost tabs on the skating blade. If such an assembly is used with a roller skate having only three in-line wheels, only the center of the three tabs in the skating blade would require a hole or slot therein for cooperatively receiving a boss from a clamping element such as first block 111 or 162. In addition, it should be appreciated that the conversion assemblies described above can be utilized without friction means such as knurls 102 or gaskets 202 and be within the scope of the present invention.

Figure 10:
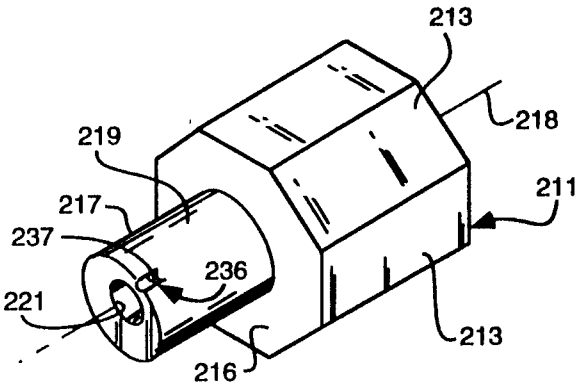
FIG. 10 is a perspective view of a clamping element relating to the clamping element shown in FIG. 7.
Figure 9:
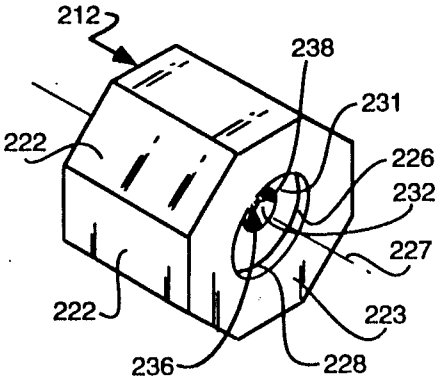
FIG. 9 is a perspective view of a clamping element of another embodiment of the conversion assembly of the present invention.

In another embodiment of the invention which is illustrated in FIGS. 9 and 10, first and second blocks 211 and 212 serve as first and second clamping elements. First block 211 is substantially similar to first block 111, being formed with eight planar side surfaces 213 which interconnect to provide block 211 with a cross section in the shape of an equilateral octagon. Block 211 further includes a first clamping surface 216, perpendicularly adjoining side surfaces 213, with a first boss 217 extending generally perpendicularly therefrom along a central longitudinal axis 218. First boss 217 has an outer surface 219 which is generally circular in cross section. A bore 221 extends through block 211 and boss 217 thereof off center longitudinal axis 218.

Second block 212 is substantially similar to second block 111 and it is formed with a plurality of side surfaces 222 which interconnect to provide block 212 with a cross section having the shape of an equilateral octagon. Second block 212 includes a second clamping surface 223 which perpendicularly adjoins each of side surfaces 222 and is provided with a cavity or recess 226 centered along a central longitudinal axis 227. Recess 226 is formed from an annular side surface 228 and a perpendicularly adjoining end surface 231. A bore 232 extends through second block 227 off center longitudinal axis 227 and opens into recess 226. Bore 232 is off center axis 227 a distance substantially equal to the distance which first block bore 221 is off center axis 218.

Blocks 211 and 212 include a key way system 236 which serves as key way means for angularly aligning boss 217 within recess 226. Key way system 236 is in the form of a longitudinal notch or groove 237 provided on the outer surface 219 of boss 217 and a cooperatively configured longitudinally extending spline 238 provided on annular side surface 228 within recess 226. Groove and spline 237 and 238 dictate alignment of bore 221 and 232 when the end portion of first block boss 217 is disposed within second block recess 226.

In operation and use, first and second blocks 211 and 212 operate substantially similar to first and second blocks 111 and 112 of conversion assembly 71. The circular cross-sectional configuration of boss 217 permits a great variety of adjustment in the elevational height of transversely aligned first block bore 221 and second block bore 232.

As can be seen, the conversion assemblies of the present invention permit attachment of a single skating blade to a number of in-line roller skate boots by adjusting the clamping elements with respect to a skating blade and boot, such as described above with respect to conversion assembly 71, or by utilizing different clamping elements for different boots, such as described above with respect to conversion assembly 151.

It is apparent from the foregoing that a new and improved assembly for converting an in-line roller skate to an ice skate has been provided which is adaptable to roller skates having wheels aligned in an arcuate side profile configuration and to roller skates having wheels aligned in a linear side profile configuration. The conversion assembly has a minimum number of components and is relatively easy to use. In addition, the conversion assembly provides a relatively rigid and sturdy attachment of the ice blade to the roller skate boot.

The foregoing descriptions of specific embodiments of the present invention have been presented for purposes of illustration and description. They are not intended to be exhaustive or to limit the invention to the precise forms disclosed, as many modifications and variations are possible in light of the above teaching. The embodiments were chosen and described in order to best explain the principles of the invention and its practical application, and to thereby enable others skilled in the art to best utilize the invention and various embodiments with various modifications as are suited to the particular use contemplated. It is intended that the scope of the invention be defined by the claims appended hereto and their equivalents.

What is claimed is:

1. In a conversion assembly for converting at least two types of in-line roller skates to ice skates for use on ice, each type of skate being comprised of a boot with a sole and a frame structure having depending first and second longitudinally extending, spaced apart parallel members, the support members having at least three sets of first and second transversely aligned bores longitudinally spaced apart thereon, the sets of first and second transversely aligned bores in the support members of one type being linearly aligned along the support members and the sets of first and second transversely aligned bores in the support members of the other type being arcuately aligned therealong, at least three wheels rotatable in a common plane disposed longitudinally between the first and second support members and fastening means for rotatably mounting the wheels to the support members, the fastening means including at least three sets of fastening elements which extend through the wheels and the first and second aligned bores in the support members, the assembly comprising a thin longitudinally extending skating blade having a bottom edge adapted to engage the ice and at least three sets of first and second clamping elements adapted to be disposed between the first and second support members in place of the wheels and having opposed clamping surfaces for frictionally engaging the skating blade, the first and second clamping elements having aligned holes therein through which the fastening elements extend to securely clamp the skating blade to the frame structure and the skating blade and the clamping elements being provided with hole position adjustment means to permit alignment of the holes in the first and second clamping elements with the aligned bores in the support members of each of the types of skates.

2. A conversion assembly as in claim 1 wherein said skating blade has opposite and generally parallel side surfaces and wherein said hole position adjustment means includes at least three longitudinally spaced apart holes extending through the side surfaces and a boss extending from the clamping surface of at least one of the first clamping elements into one of the holes in the skating blade.

3. A conversion assembly as in claim 2 wherein said hole position adjustment means includes bosses extending from each of the clamping surfaces of at least one set of said first and second clamping elements into one of the holes in the skating blade.

4. A conversion assembly as in claim 2 together with friction means carried by the opposed clamping surfaces of said at least one of the first clamping elements and the related second clamping element to reduce slipping between said clamping surfaces and the side surfaces of the skating blade.

5. A conversion assembly as in claim 4 wherein said friction means is in the form of a gasket disposed on each of said clamping surfaces.

6. A conversion assembly as in claim 2 wherein said side surfaces have knurled portions to reduce slipping of said clamping surfaces thereon.

7. In a conversion assembly for converting an in-line roller skate to an ice skate for use on ice, the in-line roller skate being of a type comprised of a boot with a sole and a frame structure having depending first and second longitudinally extending, spaced apart parallel support members, the support members having at least three sets of first and second transversely aligned bores longitudinally spaced apart thereon, at least three wheels rotatable in a common plane disposed longitudinally between the first and second support members and fastening means for rotatably mounting the wheels to the support members, the fastening means including at least three sets of fastening elements which extend through the wheels and the first and second aligned bores in the support members, the assembly comprising a thin longitudinally extending skating blade having a bottom edge adapted to engage the ice and opposite and generally parallel side surfaces, the skating blade being provided with at least three longitudinally spaced apart holes which extend through the side surfaces thereof and are formed from an inner surface having a top and bottom, and at least three sets of first and second clamping elements adapted to be disposed between the first and second support members in place of the wheels and having opposed clamping surfaces for frictionally engaging the skating blade, the first and second clamping elements having aligned holes therein through which the fastening elements extend to securely clamp the skating blade to the frame structure, the clamping surface of at least one of the first clamping elements having a boss extending therefrom along a central axis and into one of the holes in the skating blade, the boss being snugly disposed between the top and bottom of the inner surface forming said hole in the skating blade and the hole in said first clamping element extending through the boss off center from the central axis so that the hole in said first clamping element may be aligned with the respective first and second transversely aligned bores in the support members by rotation of said first clamping element relative to said hole in the skating blade.

8. A conversion assembly as in claim 1 wherein at least two of said first clamping elements have bosses extending therefrom into respective holes in the skating blade.

9. A conversion assembly as in claim 7 wherein at least one said holes in the skating blade is in the form of a longitudinally extending slot.

10. A conversion assembly as in claim 7 wherein said boss if formed by a plurality of planar surfaces aligned about said central axis.

11. A conversion assembly as in claim 7 wherein said boss extends through said hole in the skating blade and wherein the second clamping element relating to said at least one of the first clamping elements is formed with a recess in the clamping surface thereof for cooperatively receiving a portion of said boss of said at least one of the first clamping elements.

12. A conversion assembly as in claim 11 wherein said boss and recess are provided with key way means for angularly aligning said portion of the boss within the recess.

13. In a roller skate for use on ice, a boot with a sole and a frame structure having depending first and second longitudinally extending, spaced apart parallel support members, the support members having at least three sets of first and second transversely aligned bores longitudinally spaced apart thereon, a thin longitudinally extending skating blade having a bottom edge adapted to engage the ice, at least three upstanding tab portions longitudinally spaced apart along the top of the skating blade and having respective holes extending transversely therethrough and being each formed from an inner surface having a top and a bottom, at least three sets of first and second clamping elements adapted to be disposed between the first and second support members and having opposed first and second clamping surfaces for frictionally engaging the tab portions of the skating blade, and fastening means for securely clamping the skating blade to the frame structure, each set of first and second clamping elements having aligned holes therein and the fastening means including fastening element which extend through the first and second transversely aligned bores in the support members and the holes in the clamping elements, the clamping surface of at least one of the first clamping elements having a boss extending therefrom along a central axis and into one of the holes in the tab portions, the boss being disposed between the top and bottom of the inner surface forming said hole in the tab portion and the hole in said first clamping element extending through the boss off center from the central axis so that the hole in said first clamping element may be aligned with the respective first and second transversely aligned bores in the support members by rotation of said first clamping element relative to said hole in the tab portion.

* * * * *